US010840576B2

(12) United States Patent
Shapoury

(10) Patent No.: US 10,840,576 B2
(45) Date of Patent: Nov. 17, 2020

(54) MAGNETIC RINGS AS FEEDS AND FOR IMPEDANCE ADJUSTMENT

(71) Applicant: The Boeing Company, Chicago, IL (US)

(72) Inventor: Alireza Shapoury, Rancho Palos Verdes, CA (US)

(73) Assignee: THE BOEING COMPANY, Chicago, IL (US)

( * ) Notice: Subject to any disclaimer, the term of this patent is extended or adjusted under 35 U.S.C. 154(b) by 64 days.

(21) Appl. No.: 16/206,782

(22) Filed: Nov. 30, 2018

(65) Prior Publication Data

US 2020/0176846 A1 Jun. 4, 2020

(51) Int. Cl.

| | |
|---|---|
| ***H01P 5/04*** | (2006.01) |
| ***H01P 11/00*** | (2006.01) |
| ***H01P 5/22*** | (2006.01) |

(52) U.S. Cl.

CPC ..... *H01P 5/04* (2013.01); *H01P 5/222* (2013.01); *H01P 11/00* (2013.01); *H01P 11/003* (2013.01)

(58) Field of Classification Search

CPC ..... H01P 5/04; H01P 11/00; H01P 11/003
USPC ..... 333/32
See application file for complete search history.

(56) References Cited

U.S. PATENT DOCUMENTS

2015/0045785 A1* 2/2015 Beale ..... A61B 18/1815 606/33
2018/0159234 A1* 6/2018 Urbani ..... A61M 5/158

* cited by examiner

*Primary Examiner* — Benny T Lee
*Assistant Examiner* — Hafizur Rahman
(74) *Attorney, Agent, or Firm* — Parsons Behle & Latimer

(57) ABSTRACT

Design, application and implementations of magnetic loops and ring structures are disclosed which may be used to favorably shape or alter electromagnetic fluxes around the transmission lines or waveguides. In transmission lines, application of this system of rings offers opportunities in performance tuning, for example, to achieve more bandwidth or to adjust port impedances. In waveguides, these structures allow selective suppression of excitation of transverse electromagnetic modes (TEMs), hence improving TEM modal purities. The system of rings includes a substrate and a conductive structure for propagating an electromagnetic signal, the conductive structure in contact with the substrate. The device also includes an electrically conductive magnetic, non-conductive magnetic or metallic ring structure positioned within the substrate and proximate to the conductive structure.

23 Claims, 14 Drawing Sheets

MAGNETIC RINGS AS FEEDS AND FOR IMPEDANCE ADJUSTMENT

FIELD OF THE DISCLOSURE

This disclosure is generally related to the field of tuning transmission line and waveguide characteristics and, in particular, tuning transmission line and waveguide characteristics using magnetic rings.

BACKGROUND

As electrons move and pass through a transmission line, they create both electric and magnetic fields. Physical structures may interact with these electric and magnetic fields to excite signals within the transmission line, discriminate against undesirable standing or propagating modes, or adjust the transmission line characteristics to meet certain load or source requirements, either spectrally or from impedance perspectives.

Typical physical structures used to interact with electric and magnetic fields include electrical probes and short or open stubs. These structures, along with ground planes in transmission lines, may interact with electrical fields associated with signal propagating through the transmission line. Interacting with electric fields rather than magnetic fields is typically more practical because electric monopoles are possible and electric field lines have definite starting and ending points, whereas magnetic monopoles are, for now, only theoretically defined and magnetic field lines are continuous loops. Therefore, interaction with the magnetic fields has been more challenging. As such, typical devices that attempt to achieve certain characteristics within a transmission line or within a waveguide have relied on structures that manipulate electric fields associated with a standing or propagating waves or signals.

SUMMARY

Enhancements in additive/subtractive manufacturing and materials have made magnetic interactions within transmission lines and waveguides more practical and more efficient as compared to conventional structures that manipulate electric fields. Disclosed is a system that includes a magnetic ring structure positioned around the transmission lines or within waveguides. The magnetic ring structure may be used to either fine tune the transmission line for impedance matching or to excite a specific transverse-electric mode (TEM) in a waveguide while discriminating against other modes. The system may result in higher system bandwidth and lower losses compared to traditional tuning structures (for impedance tuning) or feeds (for exciting waveguides). For the purpose of ease of description, we exemplify the ring structure as a metallic ring in here, although with advancements of additive or subtractive manufacturing process and materials, the ring structure may also be made of electrically conductive magnetic, or non-conductive magnetic (e.g., ceramic ferrite) materials.

The system may be implemented in a multi-layer printed wiring board (PWB). The magnetic ring structure may include vias and traces positioned around striplines and microstriplines and can fine-tune the striplines and microstriplines to result in a specific characteristic impedance. Likewise, the system may be implemented in a waveguide formed through multiple dielectric layers. The magnetic structure may be used to prevent undesirable modes within the waveguide, while enhancing a desirable mode. In a specific exemplary embodiment, such rings can be used to fine tune an electric probe (e-probe) in an orthomode transducer.

In an embodiment, a device includes a substrate. The device further includes a conductive structure for propagating an electromagnetic signal, the conductive structure in contact with the substrate. The device also includes a ring structure positioned within the substrate and proximate to the conductive structure.

In some embodiments, the metallic ring structure is parallel to a propagation direction corresponding to the conductive structure. In some embodiments, the metallic ring structure is transverse to a propagation direction corresponding to the conductive structure and surrounds the conductive structure. In some embodiments, the metallic ring structure includes a bottom trace, multiple vias, and a top trace to form a loop. In some embodiments, the metallic ring structure includes a group of neighboring closed loops to form a winding. In some embodiments, the metallic ring structure is a magnetic ring structure. In some embodiments, the magnetic ring structure includes ferromagnetic materials, such as nickel or electroless nickel immersion gold. In some embodiments, the metallic ring structure includes copper. In some embodiments, the conductive structure is a transmission line. In some embodiments, a magnetic flux associated with the metallic ring structure is configured to manipulate a magnetic field at the transmission line to tune the transmission line. In some embodiments, the conductive structure is a waveguide, and the metallic ring structure is positioned within the waveguide. In some embodiments, a magnetic flux associated with the metallic ring structure is configured to manipulate a magnetic field within the waveguide to excite or perturb a preselected waveguide transverse electric mode (TEM) within the waveguide. In some embodiments, the device includes one or more additional magnetic ring structures positioned within the substrate and proximate to the conductive structure.

In an embodiment, a method includes forming a substrate via an additive or subtractive manufacturing process. The method further includes forming a conductive structure for propagating an electromagnetic signal, the conductive structure in contact with the substrate. The method also includes, while forming the substrate, forming a magnetic ring structure within the substrate and proximate to the conductive structure.

In some embodiments, forming the magnetic ring structure includes forming a loop of magnetic material that is parallel to a propagation direction corresponding to the conductive structure. In some embodiments, forming the magnetic ring structure includes forming a loop of magnetic material, the loop transverse to a propagation direction corresponding to the conductive structure and surrounds the conductive structure. In some embodiments, forming the magnetic ring structure includes using a three-dimensional additive process to form a bottom trace, multiple vias, and a top trace defining a loop. In some embodiments, the conductive structure is a transmission line, and a magnetic flux associated with the magnetic ring structure is configured to manipulate a magnetic field at the transmission line to tune the transmission. In some embodiments, the conductive structure is a waveguide, and the magnetic ring structure is position within the waveguide, and a magnetic flux associated with the magnetic ring structure is configured to manipulate a magnetic field within the waveguide to excite or perturb a preselected waveguide TEM within the waveguide.

In an embodiment, a method includes forming a magnetic ring structure proximate to a conductive structure for propagating an electromagnetic signal. The method further includes propagating the electromagnetic signal through the conductive structure, where the magnetic ring structure manipulates a magnetic component of the electromagnetic signal to excite or perturb a preselected waveguide mode within the structure. In some embodiments, the method includes forming additional magnetic ring structures proximate to the conductive structure.

In some embodiments, superconductivity may create a specific transverse electric mode (TEM) as a result of the Meissner effect. In this state, superconductive structures may repel the magnetic flux and alter boundary condition and flux penetration depth, hence amplifying, perturbing or suppressing specific waveguide mode. In some embodiments, the method includes forming additional superconductive magnetic ring structures proximate to a superconductive structure or transmission line.

Figure 1:
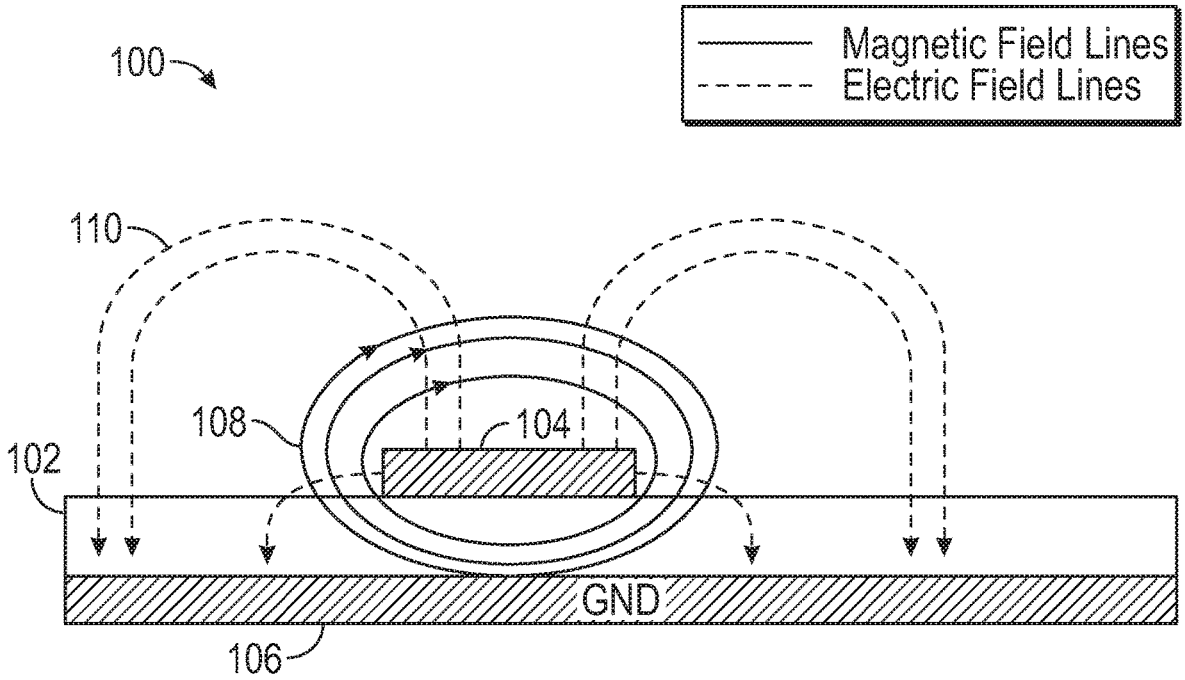
FIG. 1 depicts an embodiment of a transmission line having an electric field and a magnetic field corresponding to a propagating signal.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Referring to FIG. 1, an embodiment of a transmission device 100 having an electric flux 110 and a magnetic flux 108 corresponding to a propagating signal is depicted. The transmission device 100 may correspond to a stripline and may include a trace 102 deposited on a substrate 102. A reference or ground plane 106 may be positioned on an under portion of the substrate 102. As shown in FIG. 1, the electric flux 110 may be shaped by the reference or ground plane 106. The magnetic flux 108 may form a continuous loop around the trace 104 as the signal propagates through the transmission device 100. The magnetic flux 108 can also form in superconductive transmission lines, where the magnetic flux fields may completely or partially exclude an interior structure of the ground plane 106 and may be repelled from the trace 102, due to the Meissner effect.

Figure 2:
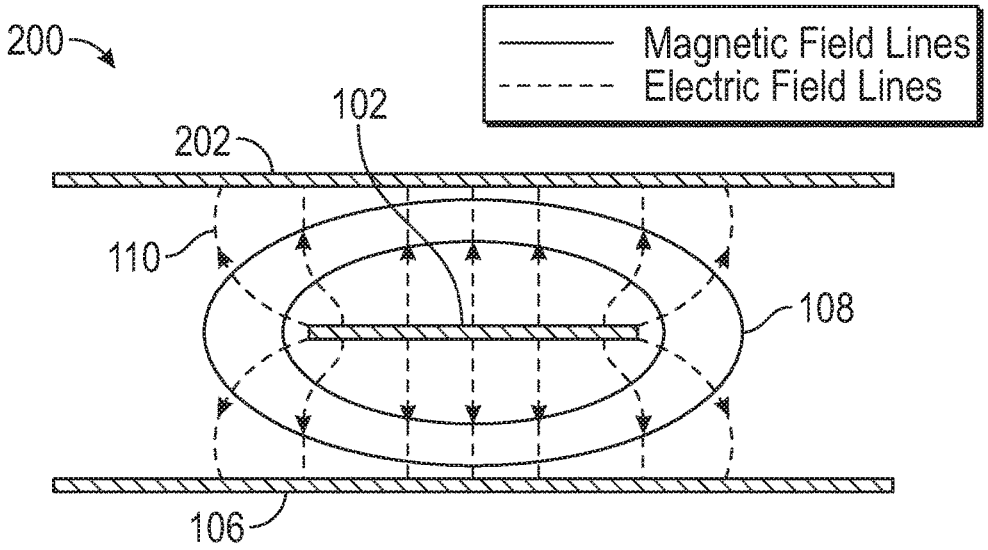
FIG. 2 depicts an embodiment of a transmission line having a second reference plane or ground to control an electric field of a propagating signal.

Referring to FIG. 2, an embodiment of a transmission device 100 having a second reference plane 202 to control the electric flux 110 of a propagating signal is depicted. Reference or ground planes, such as the reference or ground planes 106, 202 depicted in FIGS. 1 and 2 may provide shaping and controlling of the electric flux 110 associated with a propagating signal. However, these methods do not interact directly with the magnetic flux 108. The magnetic flux 108 can also form in superconductive transmission device, where the magnetic flux fields may completely or partially exclude an interior structure of the planes 106 and 202 and may also be repelled from the trace 102, due to the Meissner effect.

Figure 3:
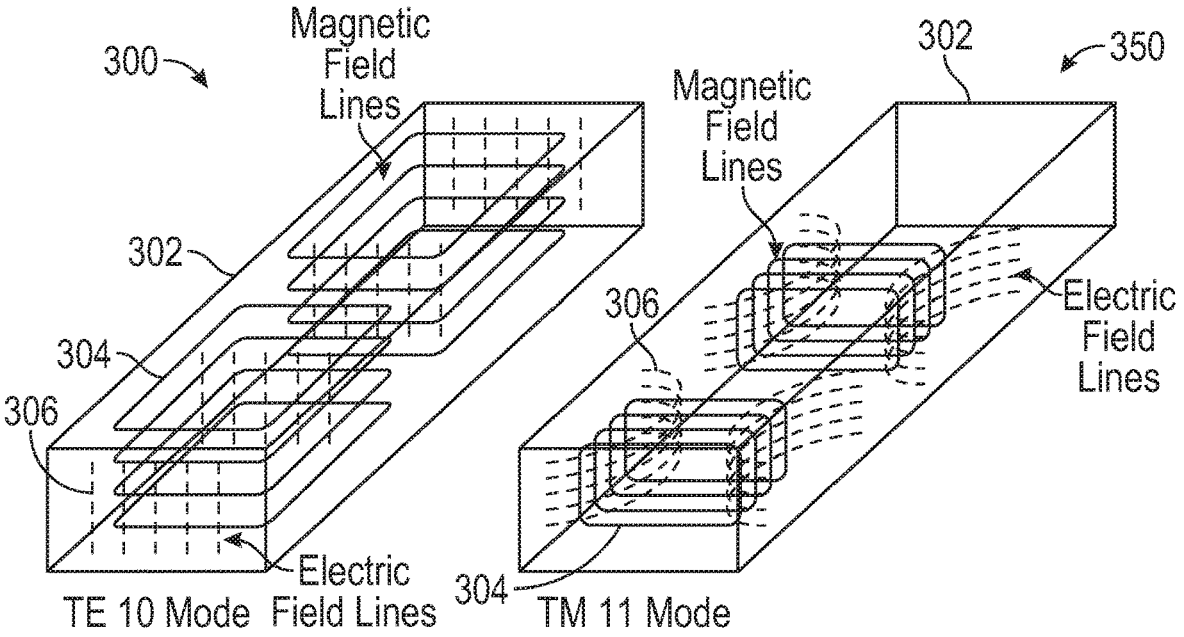
FIG. 3 depicts an embodiment of a waveguide propagating a signal in a transverse-electric (TE) mode and in a transverse-magnetic (TM) mode.

Referring to FIG. 3, an embodiment of a waveguide 302 propagating a signal in a transverse-electric (TE) mode 300 and in a transverse-magnetic (TM) mode 350 is depicted. In the TE mode 300, an electric flux 306 may run vertically from one side of the waveguide to the other, running transverse to a direction of propagation. A magnetic flux 304 may form continuous loops running parallel to the direction of propagation. In the TM mode, the electric flux 306 may run circularly, e.g., emerging from a wall of the waveguide 302 and looping back to the same wall. The magnetic flux 304 may form continuous loops running transverse to the direction of propagation. In both cases, the magnetic flux 304 may form continuous loops. The waveguide 302 does not directly interact with the magnetic flux 304, but rather interacts with the electric flux 306. In a superconductive structure the magnetic flux 304 may be repelled from the waveguide walls due to the Meissner effect.

Figure 4:
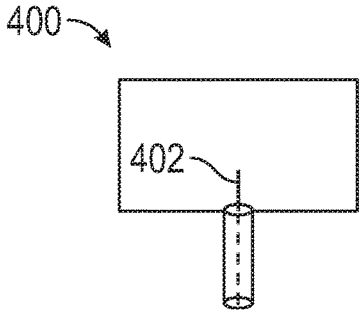
FIG. 4 depicts an embodiment of a waveguide having an e-probe which primarily excites TE10 mode.
Figure 5:
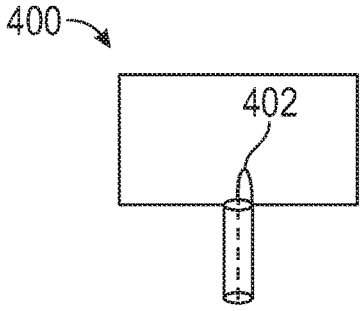
FIG. 5 depicts an embodiment of a waveguide having a coupling loop which may be optimized to excite TM11 mode.

FIG. 4 depicts an embodiment of a waveguide 400 having an e-probe 402. The e-probe 402 may be in a coupling stub configuration. In many cases, the e-probe 402 may have a length of approximately one-fourth the wavelength of a propagating signal to excite TE10 mode. The e-probe 402 may excite a particular mode in the waveguide 402. FIG. 5 depicts an embodiment of a waveguide 400 in which the e-probe 402 is in a coupling loop configuration. The particular type of configuration of the e-probe 402 may depend on which transmission mode is desired to be excited within the waveguide 400. The e-probe may excite, reduce or eliminate a particular mode by interacting with an electric flux of a propagating signal.

Figure 6:
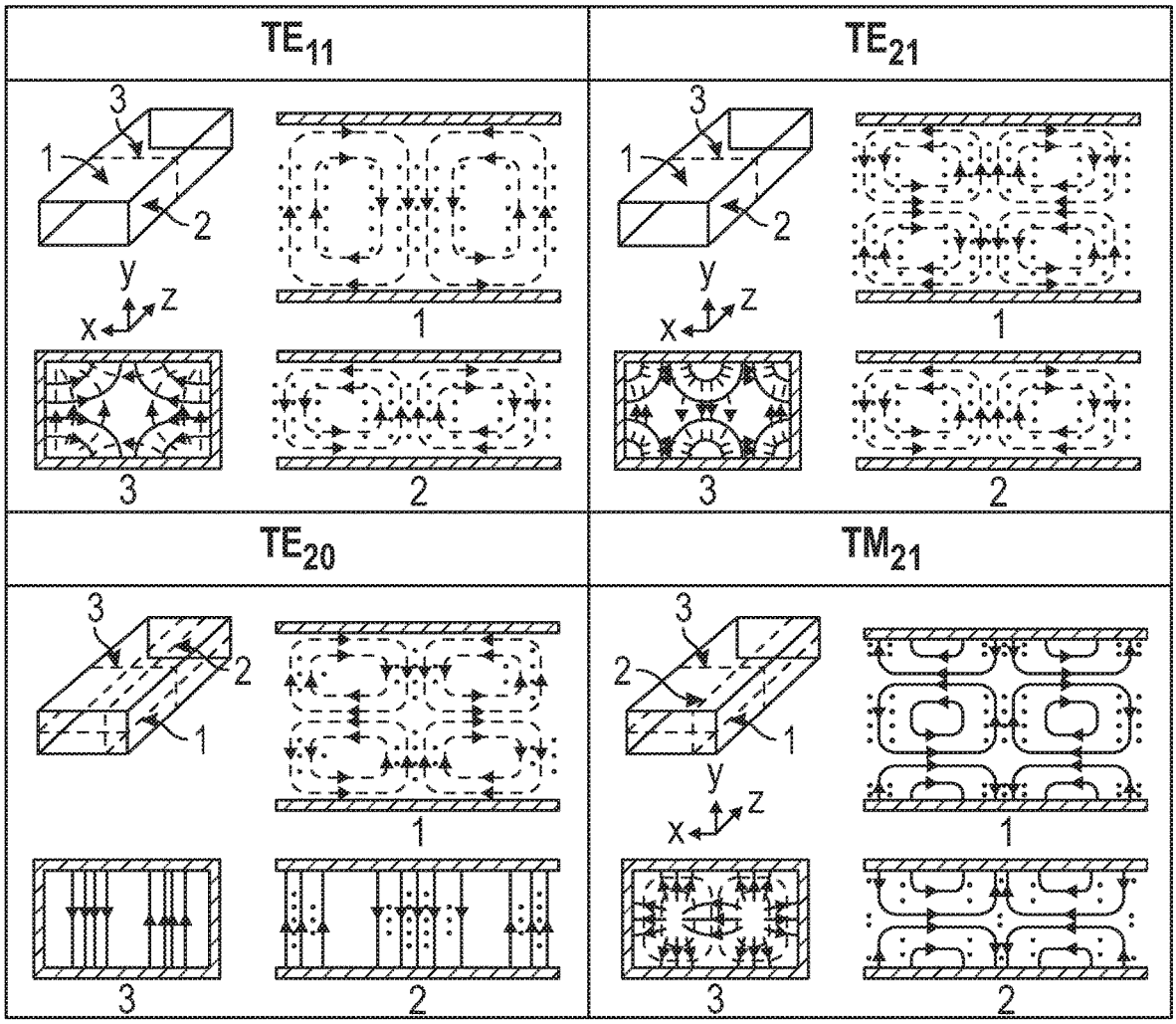
FIG. 6 depicts an assortment of TE and TM modes for a rectangular waveguide.
Figure 7:
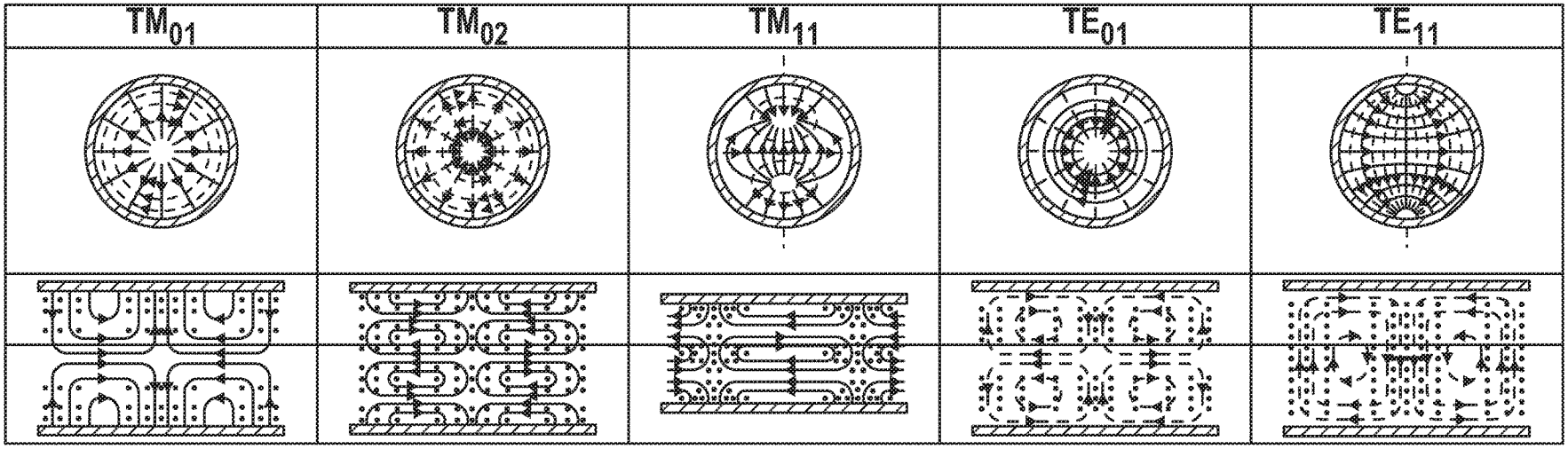
FIG. 7 depicts an assortment of TE and TM modes for a circular waveguide.

Referring to FIG. 6, an assortment of TE and TM modes for a rectangular waveguide are depicted. The modes may include, TE11, TE21, TE20, and TM21, in addition to the modes which are already illustrated in FIG. 3. While these are some common modes, other modes exist. By configuring the e-probe 402, these TE and TM modes may be excited within a waveguide, such as the waveguide 400. Referring to FIG. 7 an assortment of TE and TM modes for a circular waveguide are depicted. The modes may include TM01, TM02, TM11, TE01, and TE11. The TE11 mode is typically considered beneficial to excited because it is less vulnerable to unwanted modes (i.e., more robust). TE11 may be excited by an e-probe positioned perpendicular to a sidewall of a waveguide (e.g., from a coaxial connector) or by a rectangular to circular transformer from the back wall.

Figure 8:
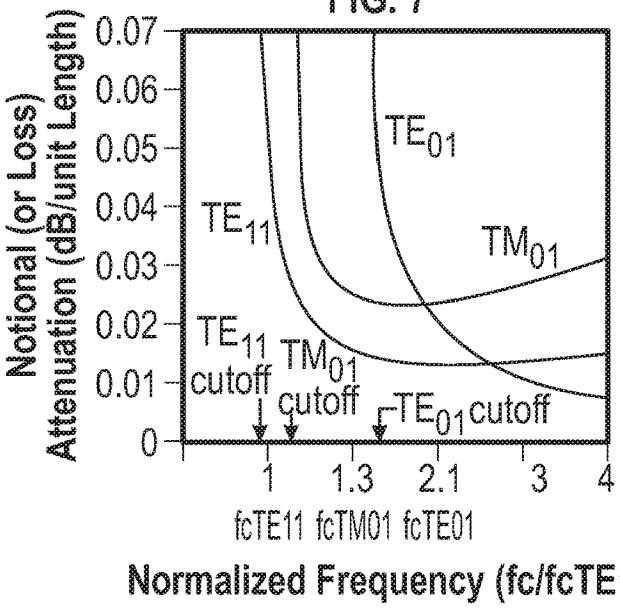
FIG. 8 depicts an attenuation per unit length associated with some modes for a circular waveguide.

Referring to FIG. 8, an attenuation per unit length associated with some modes for a circular waveguide are depicted. As shown in FIG. 8, the TE01 mode decreases to a small value with increasing frequency relative to the other modes. This property makes the TE01 mode of interest for low-loss transmission over long distances, if properly maintained and excited. Using electromagnetic rings to excite or perturb TEM modes may enable use of modes that may be more difficult to excite and maintain (e.g., the TE01 mode). Further, developments in additive and subtractive manufacturing has made it possible to implant these rings within a substrate of a transmission device itself, as described herein.

Figure 9:
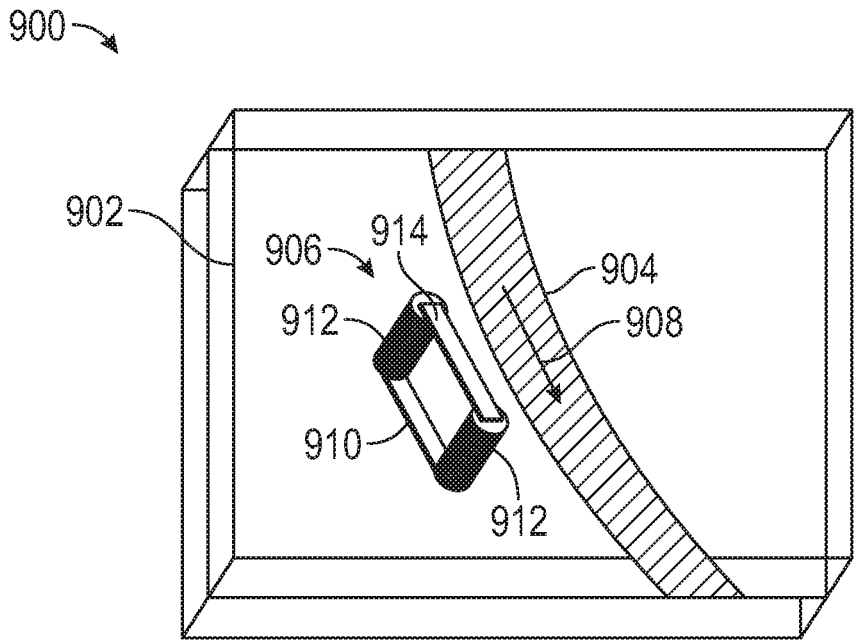
FIG. 9 depicts an embodiment of a transmission device having a parallel metallic ring structure.

Referring to FIG. 9, a transmission device 900 having a parallel metallic ring structure 906 is depicted. The device 900 may also include a substrate 902 and a transmission line 904. The substrate 902 may be a portion of a multi-layer printed wiring board (PWB). As such, the transmission line 904 may be included within a layer of the PWB, placing the transmission line in direct contact with the substrate 902. The substrate 902 may be formed by an additive or subtractive manufacturing process. The transmission line 904 may connect or otherwise route other devices (not shown) coupled to the PWB. As such, the transmission line 904 may be configured to propagate an electromagnetic signal in a direction of propagation 908.

The metallic ring structure 906 may be positioned within the substrate and may form a completed loop that runs parallel to the direction of propagation 908. As used herein, being parallel to the direction of propagation 108 means that the transmission line 904 does not pass through the metallic ring structure 906. However, it does not necessarily mean that the loop is exactly parallel to the direction of propagation 908. For example, a hypothetical plane passing through each component of the metallic ring structure 906 may run alongside the direction of propagation 908, but, in some cases, may not be exactly aligned with the direction of propagation 908, depending on a desired angle for tuning the transmission line 904. The metallic ring structure 906 may be proximate to the transmission line 904, meaning that the metallic ring structure 906 is close enough to the transmission line 904 to enable a field produced by the metallic ring structure 906 to significantly affect a signal propagating through the transmission line 904.

The metallic ring structure 906 may include a bottom trace 910, multiple vias 912, and a top trace 914 to form a loop. Further, the loop may be formed of magnetic material. Multiple of these loops can be connected in tandem at the bottom or the top of the trace to mimic a closed winding next to the transmission line 904. The metallic ring structure 906 is a magnetic ring structure and may include materials such as nickel or electroless nickel immersion gold. Other materials may also be used. In some embodiments, the metallic ring structure 906 includes copper. The metallic ring structure 906 may be formed through an additive or subtractive manufacturing process. The traces 910, 914 may be added in different layers of the substrate 902 and the vias 912 may pass through the layers to connect the traces 910, 914.

During operation, a magnetic flux associated with the metallic ring structure 906 may be configured to manipulate a magnetic field at the transmission line 904 to tune the transmission line 904. Typical tuning has previously been performed by manipulating electric field components rather than magnetic field components. An advantage of the device 900 is that an operational bandwidth may be further increased by manipulating magnetic field components, as discussed further herein. Other advantages may exist.

Figure 10:
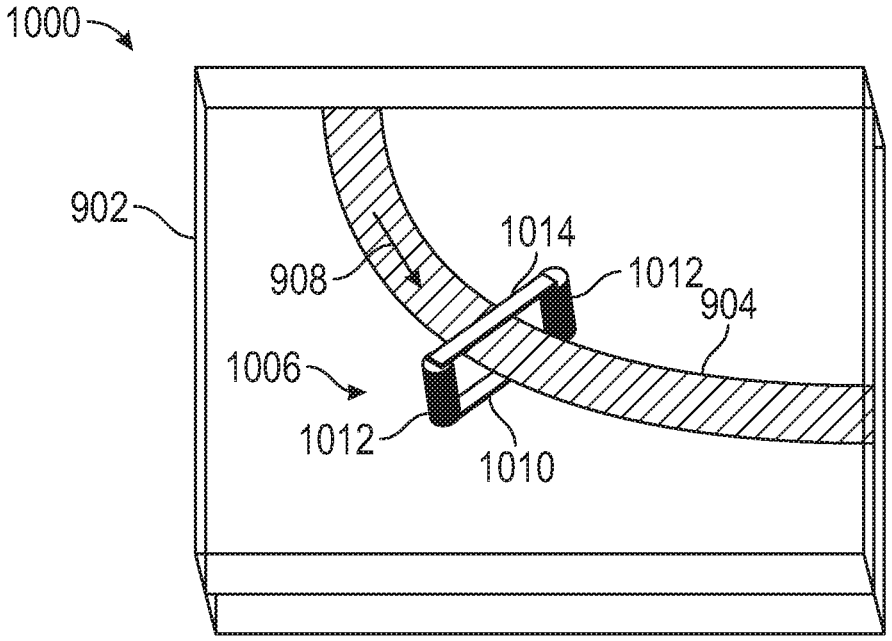
FIG. 10 depicts an embodiment of a transmission device having a transverse metallic ring structure.

Referring to FIG. 10, a transmission device 1000 having a transverse metallic ring structure 1006 is depicted. The metallic ring structure 1006 may be positioned within the substrate 902 and may form a completed loop that runs transverse to the direction of propagation 908. As used herein, being transverse to the direction of propagation 908 means that the transmission line 904 pass through the metallic ring structure 1006. However, it does not necessarily mean that the loop is exactly perpendicular to the direction of propagation 908. Rather, an angle between the metallic ring structure 1006 and the direction of propagation 908 may depending on a desired angle for tuning the transmission line 904. The metallic ring structure 1006 may be proximate to the transmission line 904, meaning that the metallic ring structure 1006 may be close enough to the transmission line 904 to enable a field produced by the metallic ring structure 1006 to significantly affect a field passing of a signal propagating through the transmission line 904.

The metallic ring structure 1006 may include a bottom trace 1010, multiple vias 1012, and a top trace 1014 to form a loop that encloses the transmission line 904. As with the metallic ring structure 906, the metallic ring structure 1006 may be a magnetic ring structure and may include materials such as nickel or electroless nickel immersion gold. Other materials may also be used. In some embodiments, the metallic ring structure 1006 includes copper. The metallic ring structure 1006 may be formed through an additive or subtractive manufacturing process. The traces 1010, 1014 may be added in different layers of the substrate 902 and the vias 1012 may pass through the layers to connect the traces 1010, 1014.

Figure 11:
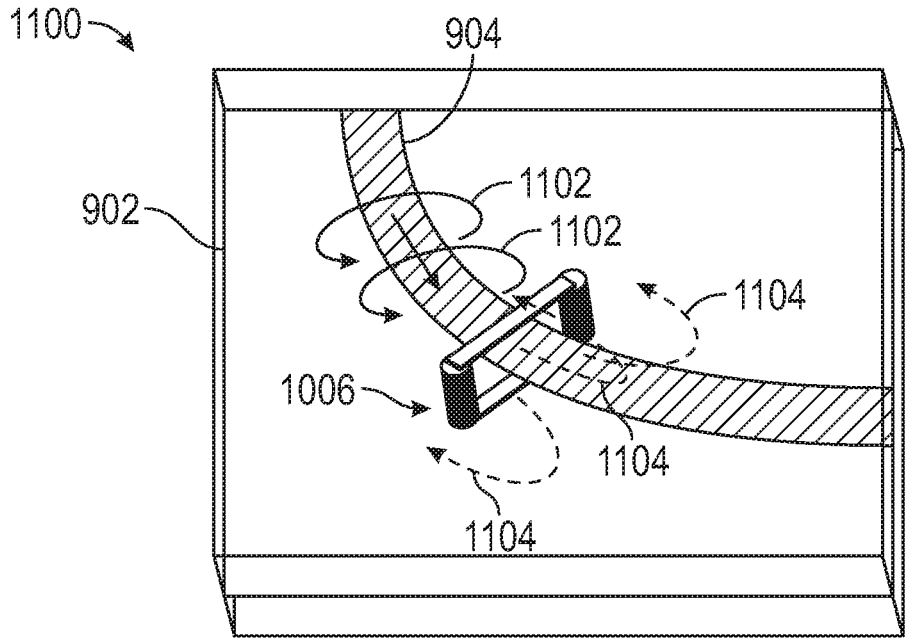
FIG. 11 depicts an embodiment of a transmission device and shows example magnetic field components.

Referring to FIG. 11, an embodiment of a transmission device 1100 including a substrate 902, a transmission line 904, and a metallic ring structure 1006 is depicted. FIG. 3 also depicts example magnetic field components 1102, 1104. The magnetic field components 1102 may correspond to an electromagnetic signal propagating through the transmission line 904. A depicted, the magnetic field components 1102 may form a continuous loop around the transmission line 904. The magnetic field components 1104, denoted by the dotted line, may correspond to the metallic ring structure 1006. The magnetic field components 1104 may interact with the magnetic field components 1102 in order to change the structure of the propagating signal and, thereby, effectively change the characteristics of the transmission line 904.

A benefit of the transmission device 1100 is that the effective characteristics of the transmission line 904 may be modified, e.g., for transmission line matching, etc., by interacting with the magnetic field components 1102 of a propagating signal rather than interacting with electric field components. This may enable a simpler approach for tuning a transmission line with potentially less interference. A particular example embodiment of a transmission line device including a metallic ring structure is described further herein. The metallic ring structures 906, 1006, presented herein, may be used to shape or alter E/M fluxes, described with reference to FIGS. 6 and 7, in three dimensions, creating, enhancing, or suppressing transverse electromagnetic modes (TEMs). By using the metallic ring structures 906, 1006 in transmission lines or waveguides, specific TE or TM excitations or suppressions may be ensured, which may increase modal purities. The electric flux may be shaped based on the above using conductors, such as cupper. For magnetic flux shaping the benefits of ferromagnetic nickel, which may be used in mainstream PWB manufacturing (e.g., Electroless Nickel Immersion Gold or ENIG finish), may be relied on in practicing the disclosed embodiments.

Figure 12:
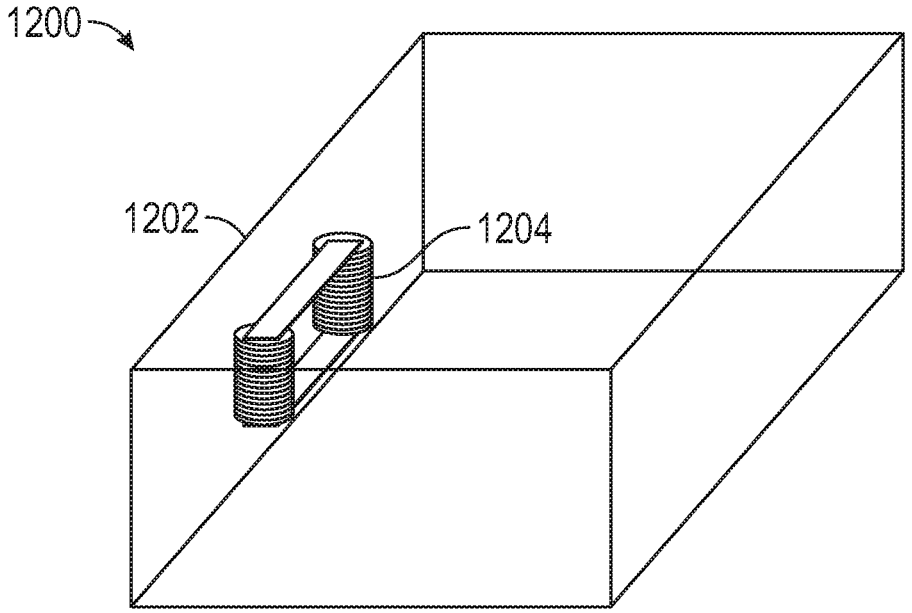
FIG. 12 depicts an embodiment of a waveguide device having a metallic ring structure.

Referring to FIG. 12, an embodiment of a waveguide device 400 having a metallic ring structure 1204 is depicted. The waveguide device 400 may include a waveguide 1202. Although FIG. 12 depicts the waveguide as being a rectangular waveguide, multiple configurations are possible. For example, in some embodiments, the waveguide device 400 may be circular. As shown in FIG. 12, the metallic ring structure 1204 may be positioned within the waveguide 1202. By positioning the metallic ring structure 1204 within the waveguide, particular transmission modes may be excited while undesirable transmission modes may be prevented. For example, the size, positioning, and magnetic properties of the metallic ring structure 1204 may correspond to a preselected waveguide mode. A particular example embodiment of a waveguide device having a metallic ring structure is described further herein.

Figure 13:
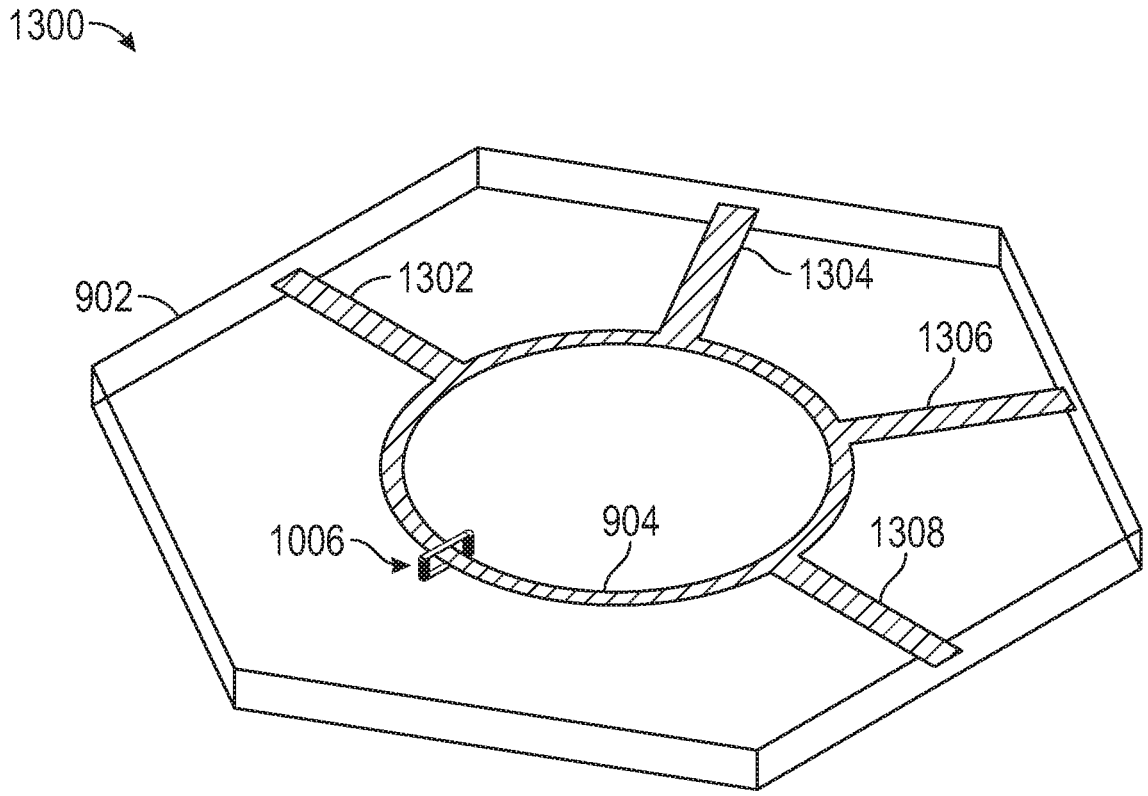
FIG. 13 depicts an embodiment of a hybrid coupler device having a transverse metallic ring structure.

Referring to FIG. 13, an embodiment of a hybrid coupler device 1300 having a transverse metallic ring structure 1006 is depicted. The device 1300 may include a transmission line 904. As depicted in FIG. 13, the transmission line 904 may include a stripline transmission line. The device 1300 may include a difference port 1302, a first in-phase port 1304, a sum port 1306, and a second in-phase port 1308. Each of the ports 1302-1308 may be spaced at one-fourth of a wavelength, with three-fourths of a wavelength spacing between the difference port 1302 and the second in-phase port 1308.

The metallic ring structure 1006 may be positioned around the transmission line 904. Further, the metallic ring structure may have magnetic properties that result in a magnetic field that perturbs the magnetic field component of a signal passing through the transmission line 904.

Figure 14:
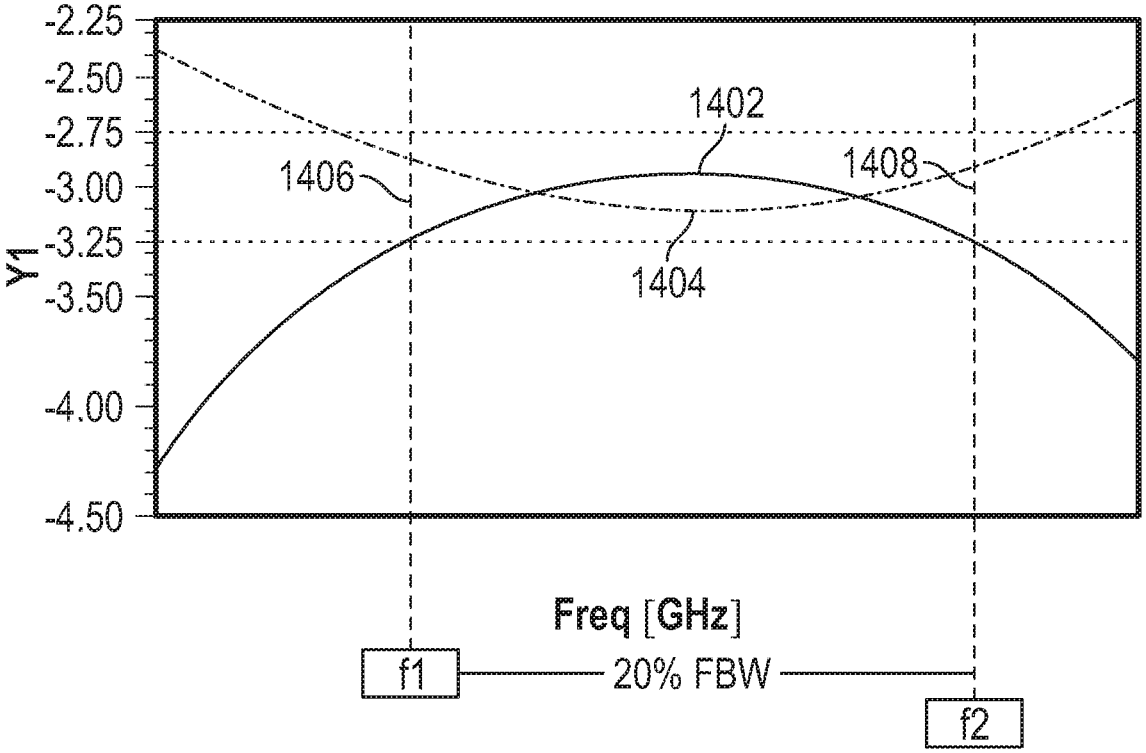
FIG. 14 depicts insertion loss bandwidth performance associated with a typical hybrid coupler device.
Figure 15:
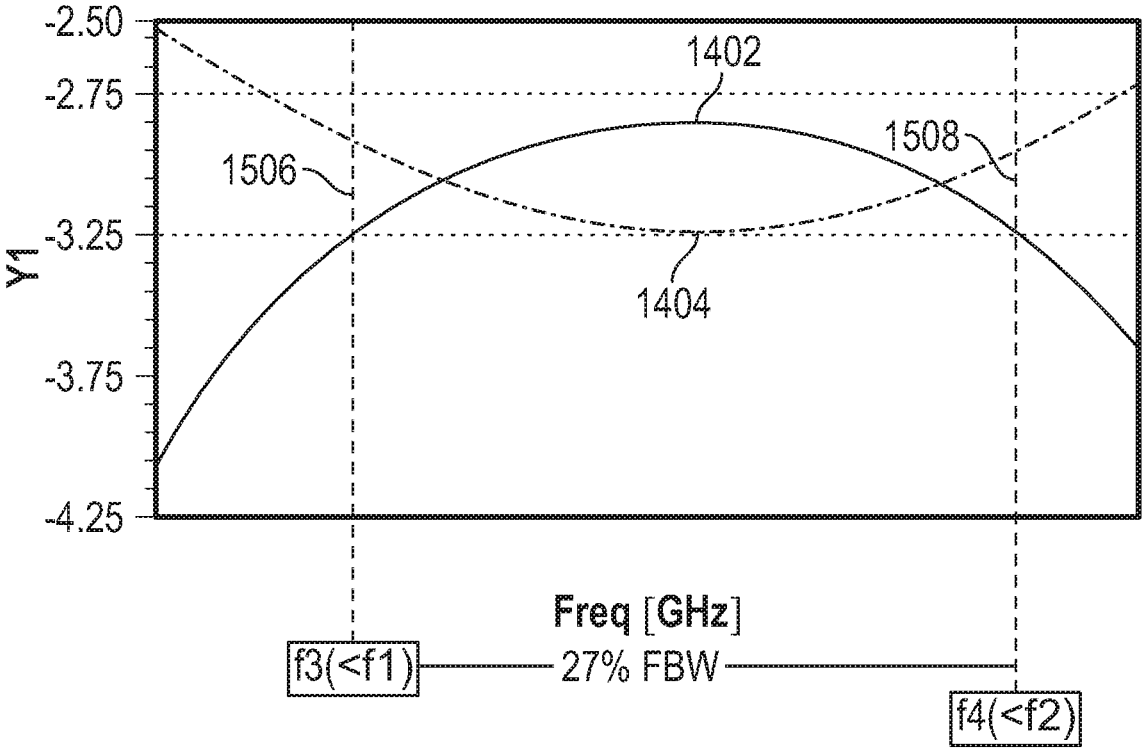
FIG. 15 depicts insertion loss bandwidth performance associated with an embodiment of a hybrid coupler device including a parallel metallic ring structure.

Referring to FIG. 14, an insertion loss bandwidth performance associated with a hybrid coupler device that has no metallic ring structure is depicted. FIG. 14 may be compared with FIG. 15, which depicts an insertion loss bandwidth performance associated with the hybrid coupler device 1300 depicted in FIG. 13. FIG. 6. may depict a first insertion loss sweep 1402 loss between the sum port 1306 and the second in-phase port 1308, and a second insertion loss sweep 1404 between the sum port 1306 and the first in-phase port 1304.

As shown in FIG. 14, for an example wideband hybrid coupler device that includes no metallic ring structure, an operational bandwidth that is within generally acceptable insertion loss thresholds is approximately 20% of the fractional bandwidth ($FBW=2(F_2-F_1)/(F_2+F_1)$), passing from the lower operational frequency at $F_1$, at 1406, to the upper frequency $F_2$, at 1408. In contrast, for the hybrid coupler device 1300 that includes the metallic ring structure 1006, an operation bandwidth that is within generally acceptable insertion loss thresholds is approximately 27% FBW from lower frequency $F_3$ ($<F_1$), at 1506, to upper frequency $F_4$ ($>F_2$), at 1508. Thus, the hybrid coupler device has an increased bandwidth compared to a typical hybrid coupler device with addition of a simple structure 1006.

Figure 16:
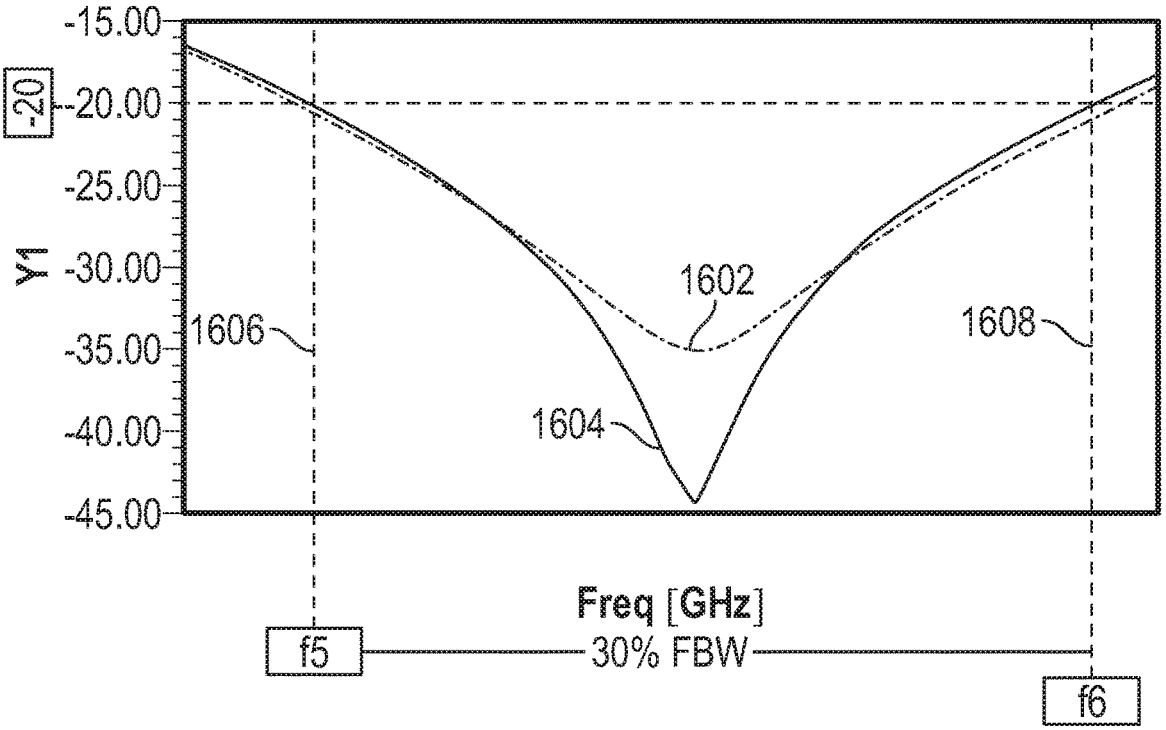
FIG. 16 depicts isolation performance associated with a typical hybrid coupler device.
Figure 17:
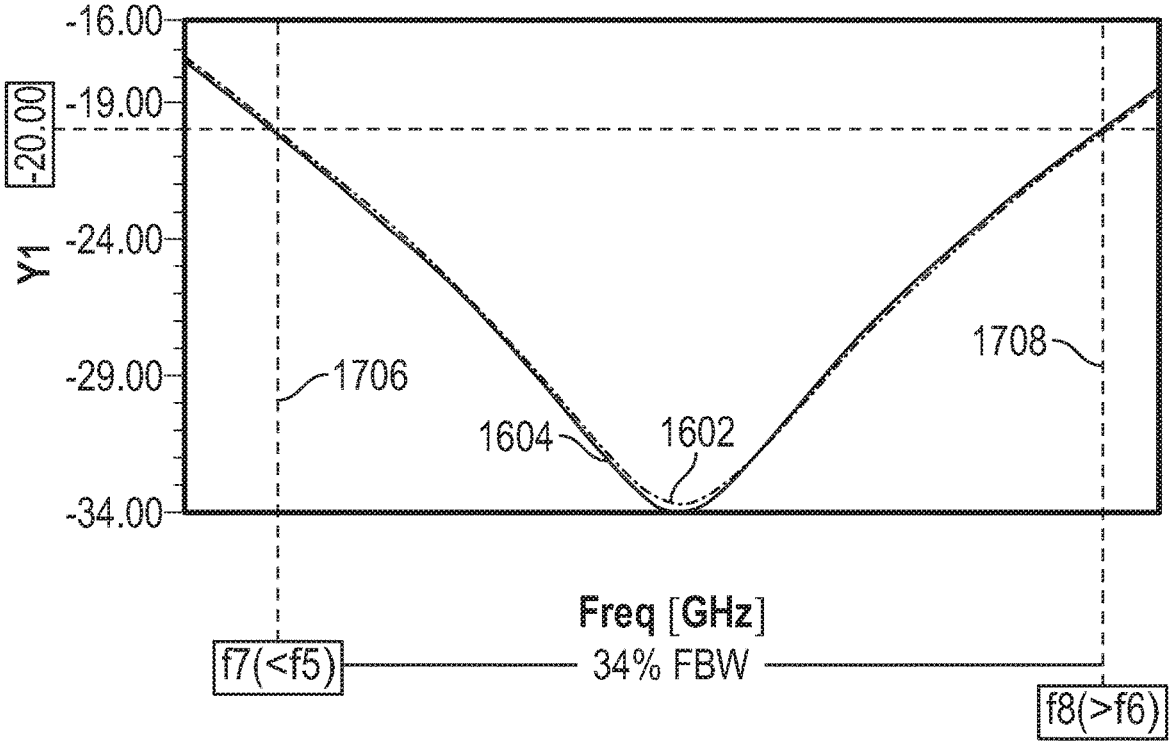
FIG. 17 depicts isolation performance associated with an embodiment of a hybrid coupler device including a parallel metallic ring structure.

Referring to FIG. 16, an isolation loss bandwidth performance associated with a hybrid coupler device that has no metallic ring structure is depicted. FIG. 16 may be compared with FIG. 17, which depicts an isolation loss bandwidth performance associated with the hybrid coupler device 1300 depicted in FIG. 13. FIG. 8 may include a first isolation loss sweep 1602 between the difference port 1302 and the sum port 1306 and a second isolation loss sweep 1604 between the second in-phase port 1308 and the first in-phase port 1304.

As shown in FIG. 16, for a typical hybrid coupler device that includes no metallic ring structure, an operational bandwidth that is within generally acceptable isolation loss thresholds is approximately 30% FBW, from lower operational frequency $F_5$, at 1606, to upper frequency $F_6$, at 1608. In contrast, for the hybrid coupler device 1300 that includes the metallic ring structure 1006, an operation bandwidth increases to 34% FBW from $F_7$ ($<F_5$) at 1706 to $F_8$ ($>F_6$), at 1708. Thus, the new hybrid coupler device has an increased isolation loss bandwidth compared to a typical hybrid coupler device.

Figure 18:
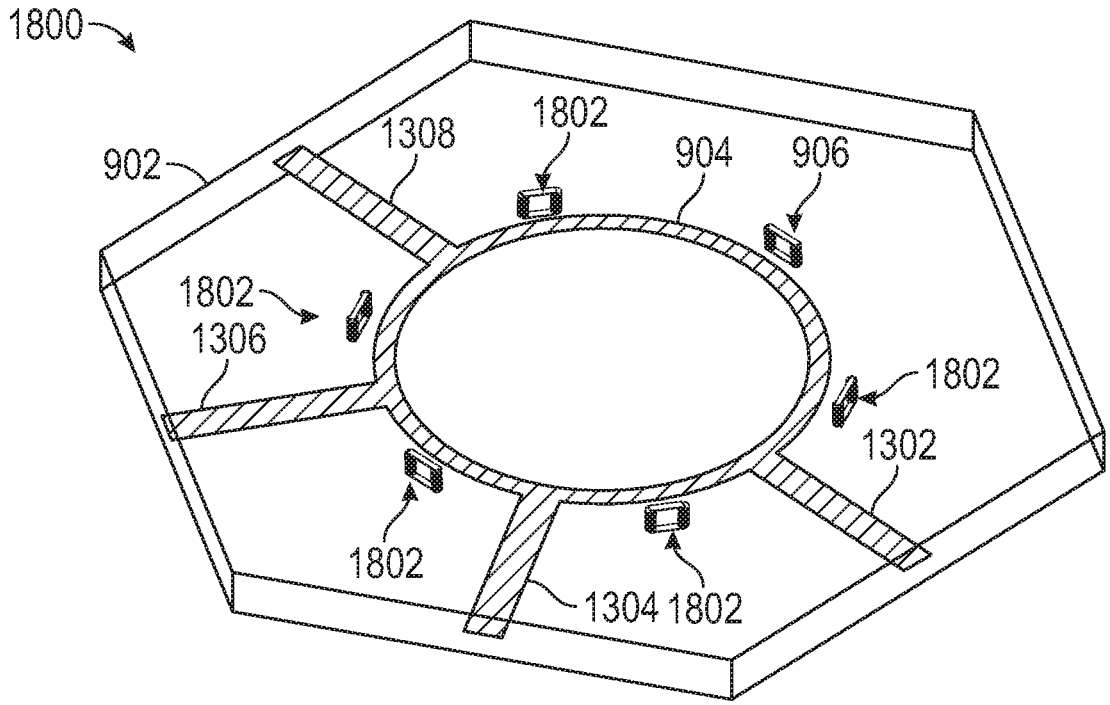
FIG. 18 depicts an embodiment of a hybrid coupler device having parallel metallic ring structures.

Referring to FIG. 18, an embodiment of a hybrid coupler device 1800 having a plurality of parallel metallic ring structures 1802 is depicted. The device 1800 may include a transmission line 904. As depicted in FIG. 13, the transmission line 904 may include a stripline transmission line. The device 1800 may include a difference port 1302, a first in-phase port 1304, a sum port 1306, and a second in-phase port 1308. Each of the ports 1302-1308 may be spaced at one-fourth of a wavelength, with three-fourths of a wavelength spacing between the difference port 1302 and the second in-phase port 1308.

The plurality of metallic ring structures 1802 may be positioned along the transmission line 904. Further, the plurality of metallic ring structures 1802 may each have magnetic properties that result in a magnetic field that perturbs the magnetic field component of a signal passing through the transmission line 904. As such, the transmission line 904 may be tuned to effectively exhibit particular characteristics desirable for a particular application.

Figure 19:
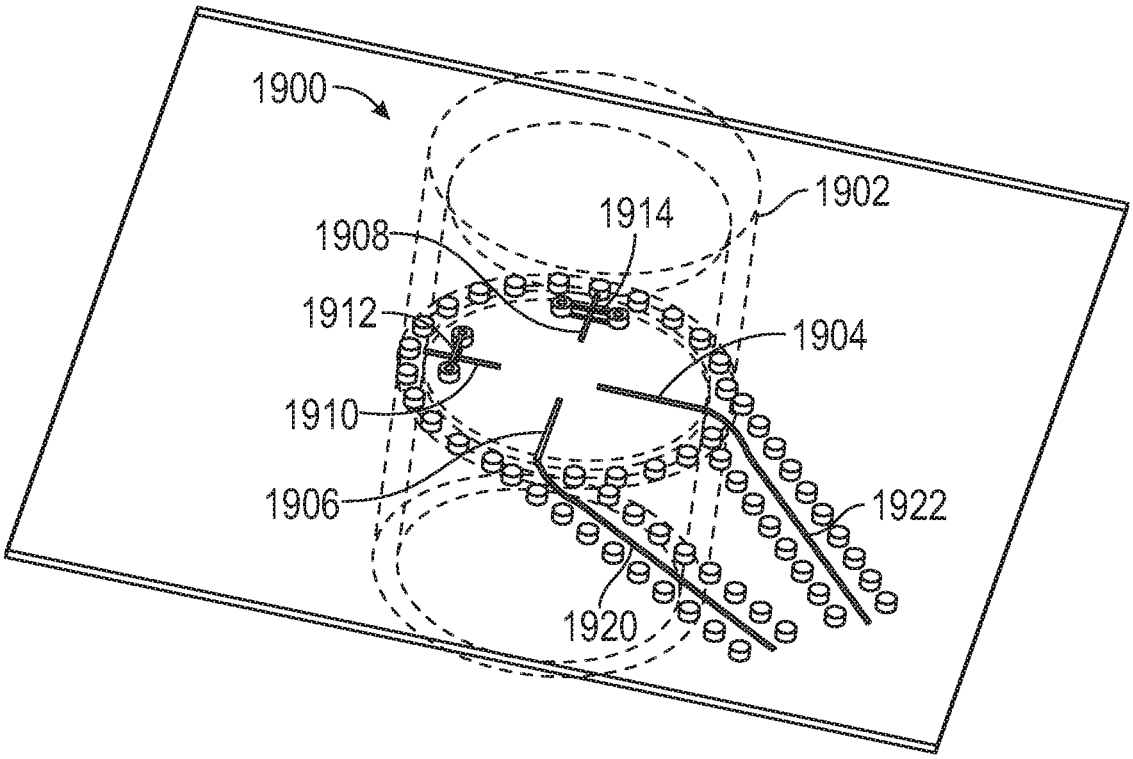
FIG. 19 depicts an embodiment of a compact orthomode transducer having parallel metallic ring structures.

Referring to FIG. 19, an embodiment of a compact orthomode transducer device 1900 having parallel metallic ring structures 1912, 1914 is depicted. The device 1900 may include a waveguide 1902, and four antisymmetric probes 1904, 1906, 1908, 1910. A first probe 1908 and a second probe 1910 may be grounded while a third probe 1904 and a fourth probe 1906 may be coupled to inputs 1120, 1122 as depicted in FIG. 19. The device 1900 may be manufactured in an additive process (e.g., a three-dimensional printing process) with the probes 1904, 1906, 1908, 1910 being formed as striplines within a dielectric (not shown) positioned within the waveguide 1902.

The device 1900 may include a first metallic ring structure 1912 and a second metallic ring structure 1914. The first metallic ring structure 1912 may be transverse to the second probe 1910 and parallel to the waveguide 1902. The second metallic ring structure 1914 may be transverse to the probe 1908 and may also be parallel to the waveguide 1902.

The metallic ring structures 1912, 1914 may include magnetic properties that are preselected to interact with a magnetic field component of a signal propagating through the waveguide 1902 in order to excite a particular transmission mode within of the signal within the waveguide 1902. Although in the embodiment of FIG. 19, the metallic ring structures are positioned around grounded probes, the probes 1908, 1910, other embodiments having different configurations of the metallic rings structures 1912, 1914 are possible. Further, a magnetic strength of the metallic rings structures 1912, 1914 may be adjusted to accommodate different transmission modes or otherwise fine tune the waveguide 1902.

Figure 20:
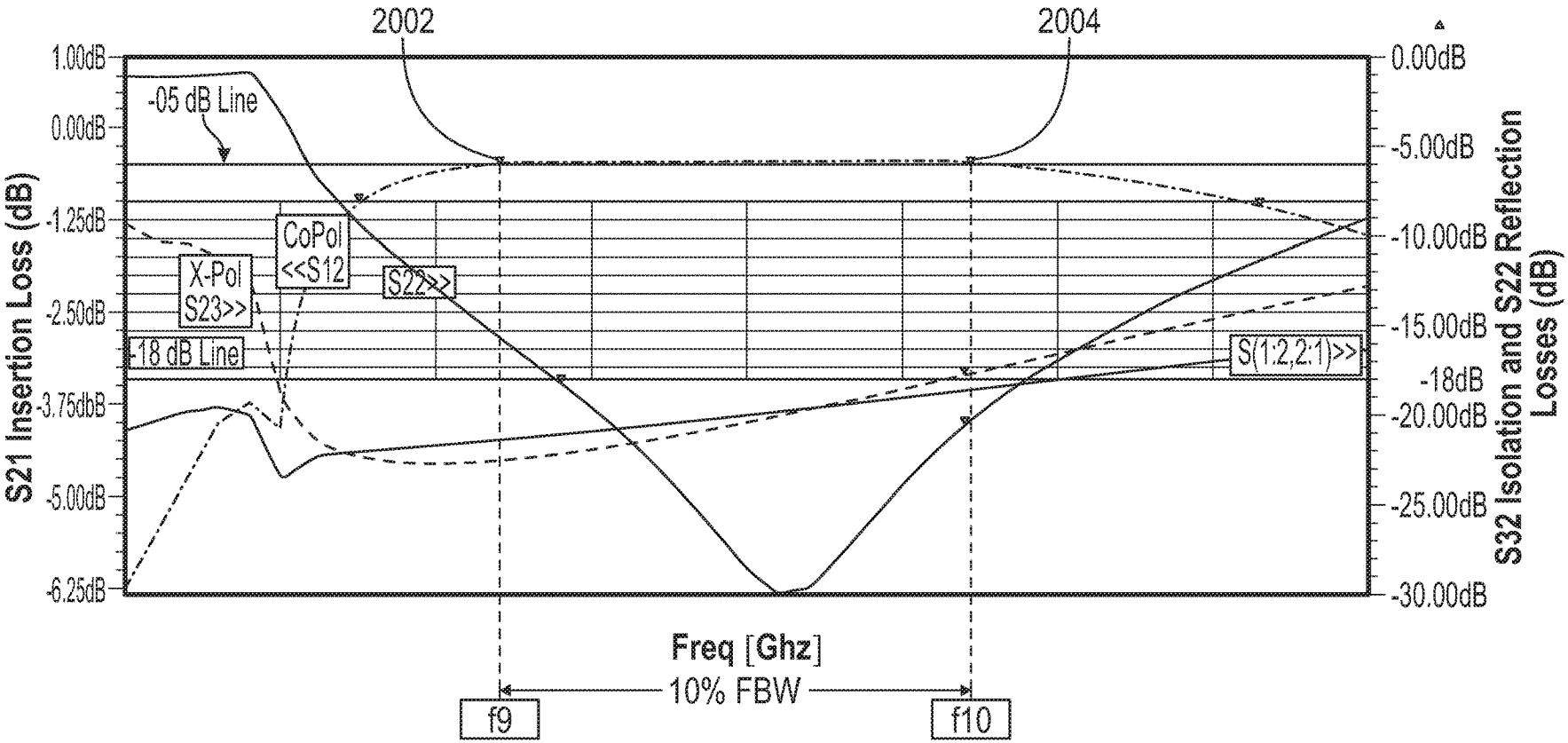
FIG. 20 depicts insertion loss bandwidth performance associated with a typical compact orthomode transducer.

Referring to FIG. 20, an insertion loss bandwidth performance associated with a compact orthomode transducer that has no metallic ring structures is depicted. FIG. 20 may be compared with FIG. 13, which depicts an insertion loss bandwidth performance associated with the compact orthomode transducer device 1900 depicted in FIG. 19.

Figure 21:
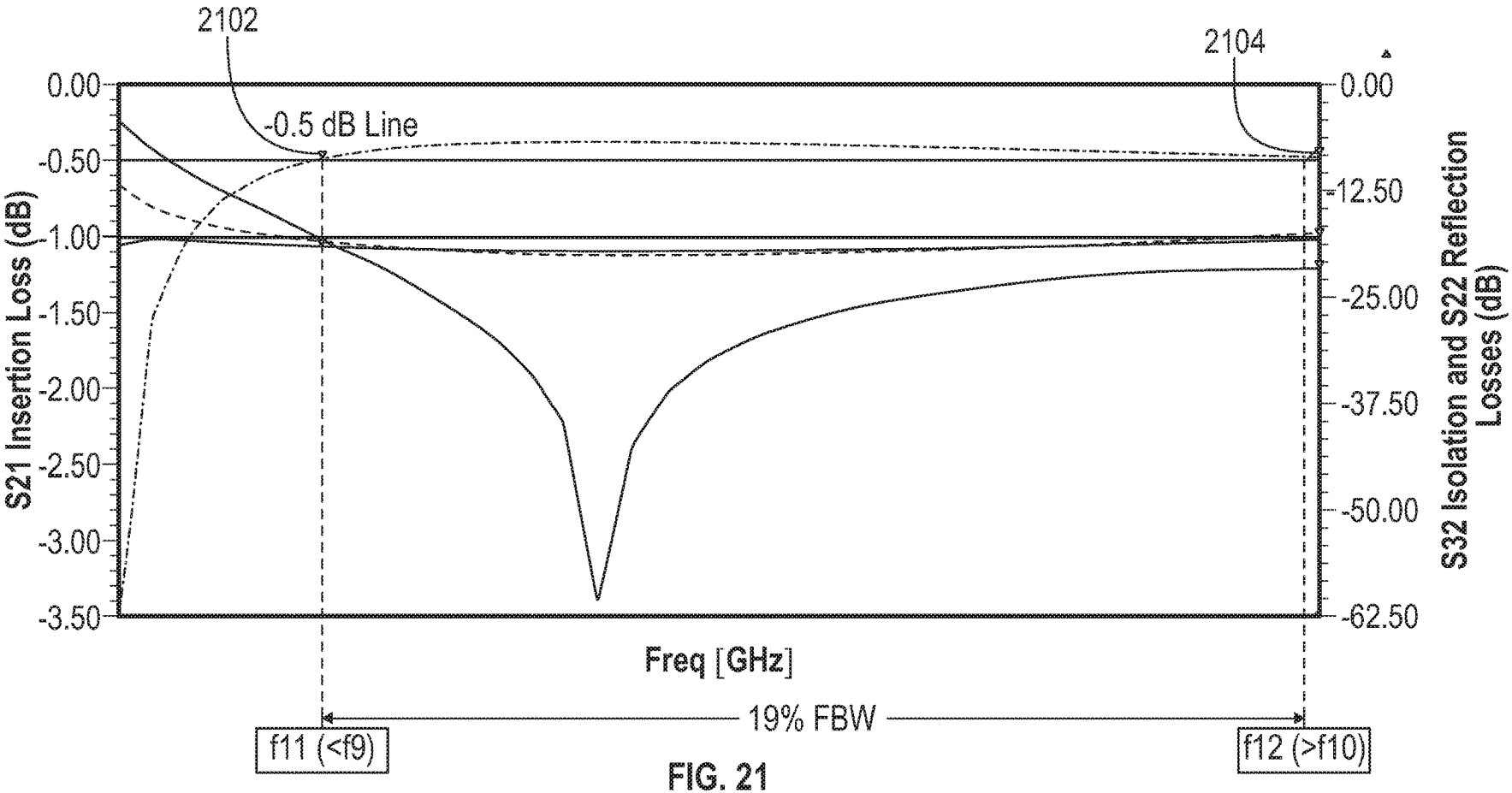
FIG. 21 depicts insertion loss bandwidth performance associated with an embodiment of a compact orthomode transducer having parallel metallic ring structures.

As shown in FIG. 20, for an example orthomode transducer device that includes no metallic ring structure, an operational bandwidth that is within generally acceptable insertion loss thresholds is approximately 10% FBW, passing from lower frequency $F_9$, at 2002, to upper operational frequency $F_{10}$, at 2004. In contrast, for the compact orthomode transducer device 1900 that includes the metallic ring structures 1912, 1914, as shown in FIG. 21, the FBW is increased to 19% FBW, from lower frequency $F_{11}$ ($<F_9$), at 2102, to upper frequency, $F_{12}$ ($>F_{10}$), at 2104. Thus, the compact orthomode transducer device 1900 has an increased insertion loss FBW by 9% compared to the performance shown at FIG. 20 of an example transducer without using this disclosure.

Further, other parameters, as shown by lines the additional function sweep lines in FIGS. 20 and 21, show that similar operation in other parameters between the two orthomode transducers. Thus, the inclusion of the metallic ring structures 1912, 1914 may significantly improve the operation of the orthomode transducer device 1900. The metallic ring structures 1912, 1914 may be used to shape magnetic fluxes, creating, enhancing, or suppressing transverse electromagnetic modes (TEMs) (e.g., the TE01 mode described with reference to FIGS. 7 and 8). By using the metallic ring structures 1912, 1914 in waveguides, these specific TE or TM excitations or suppressions may be ensured. To improve shaping magnetic flux, the ring structures 1912, 1914 may include ferromagnetic materials, such as nickel or electroless nickel immersion gold. Other advantages may exist.

Figure 22:
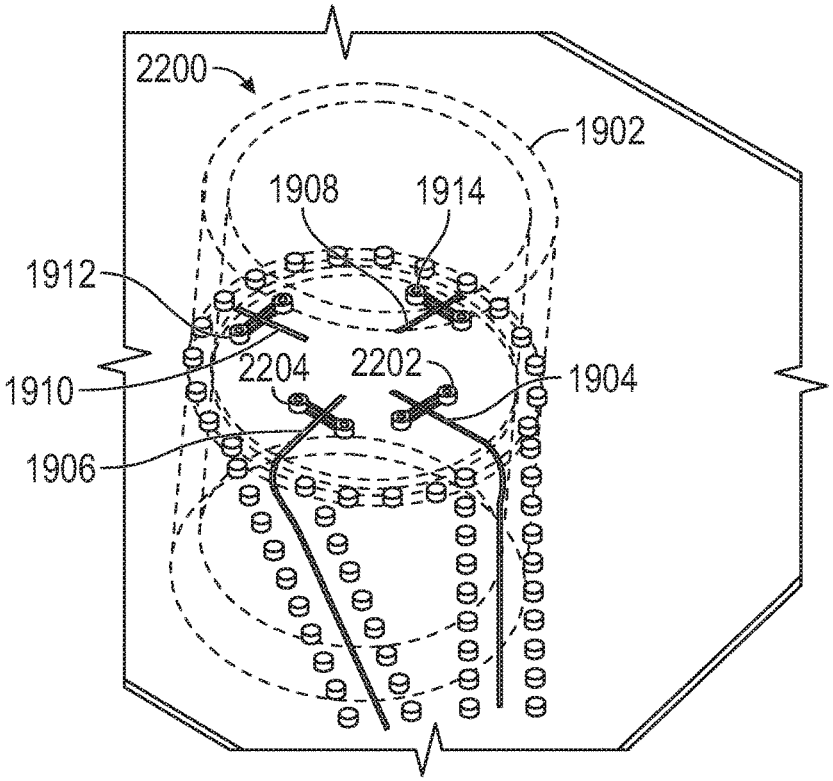
FIG. 22 depicts an embodiment of a compact orthomode transducer having additional parallel metallic ring structures.

Referring to FIG. 22, an embodiment of a compact orthomode transducer device 2200 having additional parallel metallic ring structures 2202, 2204, in additional to the metallic ring structures 1912, 1914 is depicted. The device 2200 may include a waveguide 1902, and four antisymmetric probes 1904, 1906, 1908, 1910. A first probe 1908 and a second probe 1910 may be grounded while a third probe 1904 and a fourth probe 1906 may be coupled to inputs 2202, 2204, similar to the device 1900 depicted in FIG. 19.

The additional metallic ring structures 2202, 2204 may be transverse to the third and fourth probes 1904, 1906, respectively and the probe 1904 may pass through a loop formed by the additional metallic ring structure 2202, while the probe 1906 may pass through the metallic ring structure 2202. This may further assist the waveguide device 2200 in exciting a particular transmission mode while reducing, or eliminating, other modes. For example, the device 2200 may operate in a different mode, or at different wavelengths, than the device 1900. As such, FIG. 22 represents another possible configuration of a compact orthomode transducer.

Figure 23:
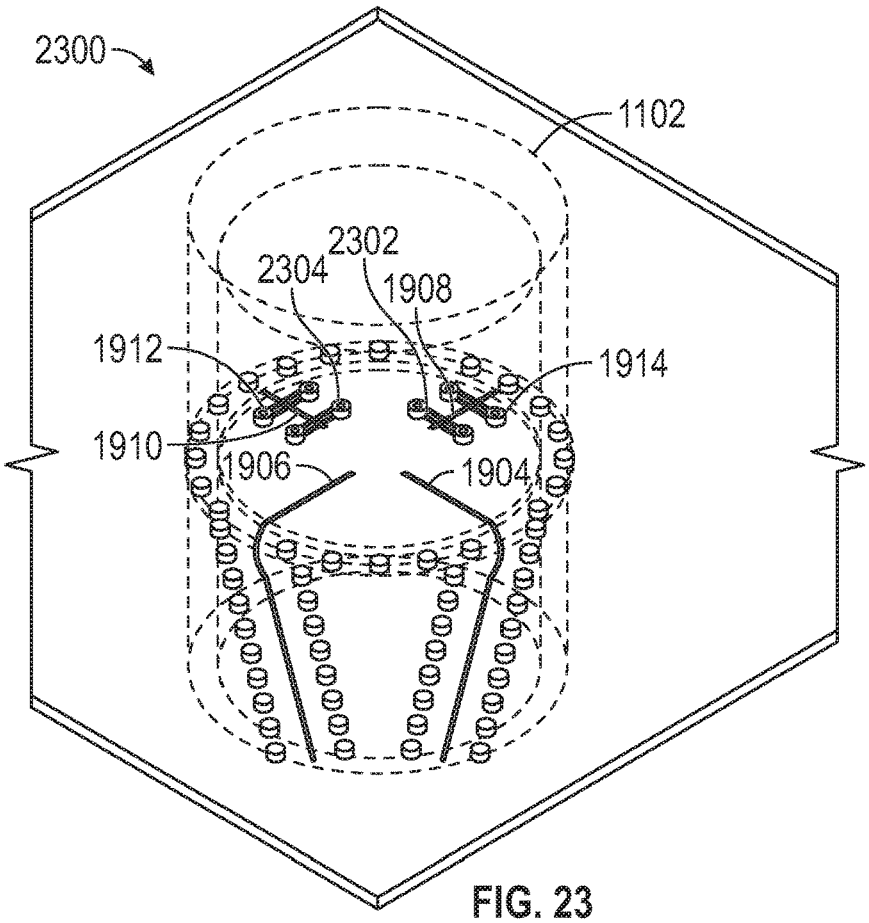
FIG. 23 depicts an embodiment of a compact orthomode transducer having additional parallel metallic ring structures.

Referring to FIG. 23, yet another embodiment of a compact orthomode transducer device 2300 having additional parallel metallic ring structures 2302, 2304 is depicted. In the device 2300 the first probe 1908 and the second probe 1910 may pass through the first additional metallic ring structure 2302 and the second additional metallic ring structure 2304. As such, FIG. 23 represents yet another possible configuration of a compact orthomode transducer.

Each of the compact orthomode transducer devices 1900, 2200, 2300 may be manufactured using an additive or subtractive manufacturing process which may provide sufficient resolution to enable their respective metallic ring structures to excite and/or reduce particular transmission modes in short wavelength, such as microwave and millimeter wave signals.

Figure 24:
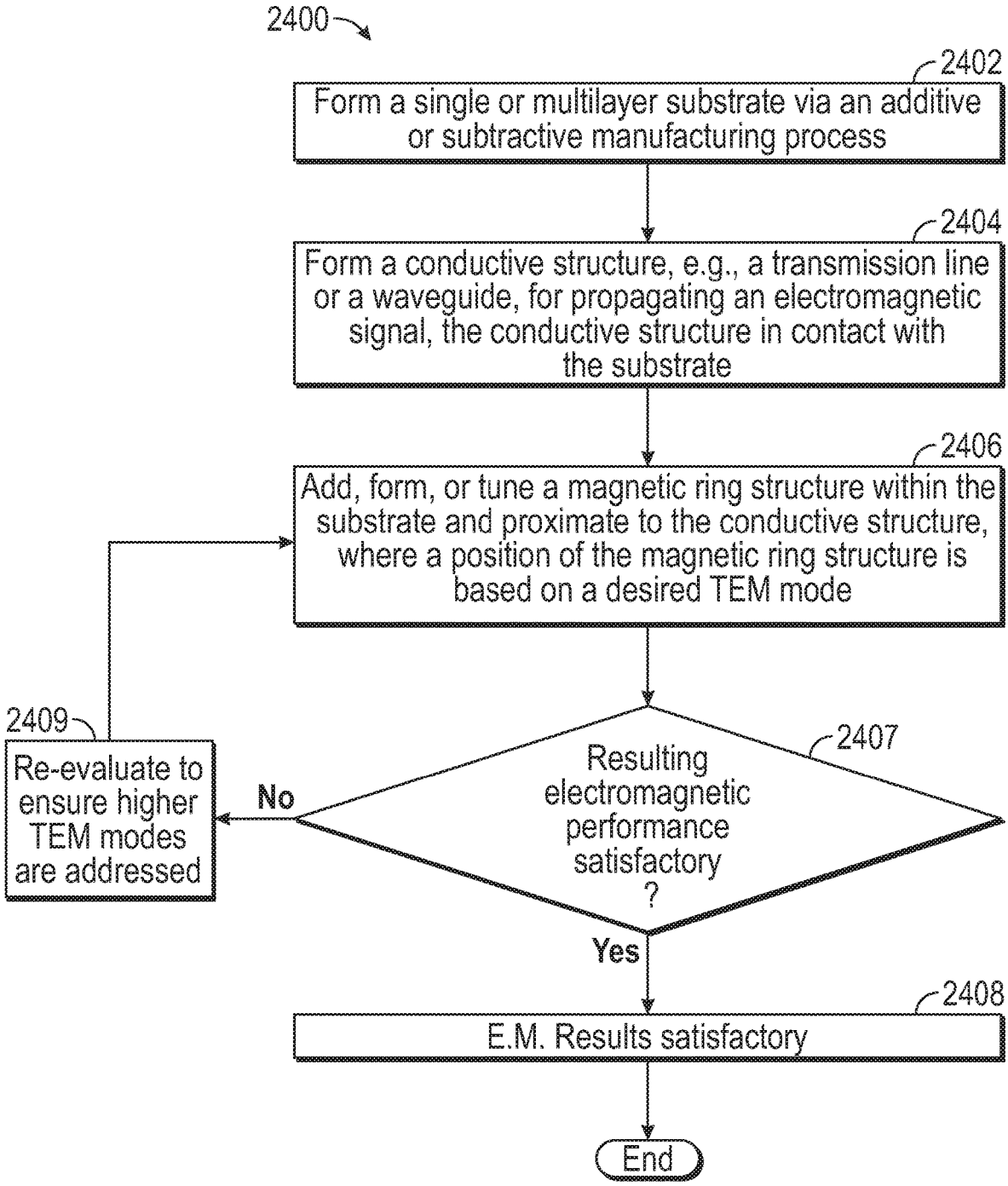
FIG. 24 depicts a flow chart of an embodiment of a method for forming a conductive structure for propagating an electromagnetic signal.

Referring to FIG. 24, a method 2400 for forming a conductive structure for propagating an electromagnetic signal is depicted. The method 2400 may include forming a substrate via an additive or subtractive manufacturing process, at 2402. For example, the substrate 902 may be formed.

The method 2400 may further include forming a conductive structure for propagating an electromagnetic signal, the conductive structure in contact with the substrate, at 2404. For example, the transmission line 904 may be formed in contact with the substrate 902.

The method 2400 may also include, while forming the substrate, forming a magnetic ring structure within the substrate and proximate to the conductive structure, at 2406. For example, the metallic ring structure 906 may be formed within the substrate 902 and proximate to the transmission line 904.

The method 2400 may include propagating the electromagnetic signal through the conductive structure, at 2408. For example, an electromagnetic signal may be propagated through the transmission line 904 in the direction of propagation 908.

By using an additive or subtractive manufacturing process to form a conductive structure, such as a transmission line or a waveguide, a metallic ring structure may be formed that is refined enough to excite a desired transmission mode and/or tune a transmission line. Other advantages may exist.

Although various embodiments have been shown and described, the present disclosure is not so limited and will be understood to include all such modifications and variations as would be apparent to one skilled in the art.

What is claimed is:

1. A device comprising:

a multi-layer substrate having similar or dissimilar substrate layers;

a conductive structure for propagating an electromagnetic signal, the conductive structure in contact with the multi-layer substrate; and a ring structure positioned within the multi-layer substrate and proximate to the conductive structure.

2. The device of claim 1, further comprising:

one or more additional magnetic ring structures positioned within the multi-layer substrate and proximate to the conductive structure.

3. The device of claim 1, wherein the ring structure may be made of electrically conductive magnetic, non-conductive magnetic or metallic materials.

4. The device of claim 1, wherein the ring structure is parallel to a propagation direction of the electromagnetic signal at the conductive structure.

5. The device of claim 1, wherein the ring structure is transverse to a propagation direction of the electromagnetic signal at the conductive structure and surrounds the conductive structure.

6. The device of claim 1, wherein the ring structure includes a bottom trace, multiple vias, and a top trace to form a loop.

7. The device of claim 1, wherein the ring structure is a magnetic ring structure that includes nickel or electroless nickel immersion gold, ceramics, another alloy, or a combination thereof.

8. The device of claim 1, wherein the ring structure includes copper, gold, platinum, or a combination thereof.

9. The device of claim 1, wherein the conductive structure includes at least one superconductive material.

10. The device of claim 1, wherein the conductive structure is a transmission line.

11. The device of claim 10, wherein a magnetic flux associated with the ring structure is configured to manipulate a magnetic field at the transmission line to tune the transmission line.

12. The device of claim 1, wherein the conductive structure is a waveguide, and wherein the ring structure is positioned within the waveguide.

13. The device of claim 12, wherein a magnetic flux associated with the ring structure is configured to manipulate a magnetic field within the waveguide to excite or perturb a preselected waveguide mode within the waveguide.

14. A method comprising:

forming a substrate via an additive or subtractive manufacturing process;

forming a conductive structure for propagating an electromagnetic signal, wherein the conductive structure is in contact with the substrate; and while forming the substrate, forming a magnetic ring structure within the substrate and proximate to the conductive structure, wherein forming the magnetic ring structure includes forming a loop of magnetic material, wherein the loop is formed transverse to a propagation direction of the electromagnetic signal at the conductive structure and surrounds the conductive structure.

15. The method of claim 14, wherein the conductive structure is superconductive, wherein a first magnetic flux is expelled from the conductive structure and is shaped based on a Meissner effect, wherein the conductive structure is a waveguide, and wherein a second magnetic flux associated with the magnetic ring structure is configured to manipulate a magnetic field within the waveguide to excite or perturb a preselected waveguide mode within the waveguide.

16. The method of claim 14, wherein forming the magnetic ring structure further comprises:

forming a loop of magnetic or non-magnetic material that is parallel to a propagation direction of the electromagnetic signal at the conductive structure.

17. The method of claim 14, wherein the conductive structure is superconductive, wherein a first magnetic flux is expelled from the conductive structure and is shaped based on a Meissner effect, and wherein a second magnetic flux associated with the magnetic ring structure is configured to manipulate a magnetic field around a transmission line.

18. The method of claim 14, wherein forming the magnetic ring structure comprises:

using a three-dimensional additive process to form a bottom trace, multiple vias, and a top trace defining a loop.

19. The method of claim 14, wherein the conductive structure is a transmission line, and wherein a magnetic flux associated with the magnetic ring structure is configured to manipulate a magnetic field at the transmission line to tune the transmission line.

20. The method of claim 14, wherein the conductive structure is a waveguide, wherein the magnetic ring structure is positioned within the waveguide, and wherein a magnetic flux associated with the magnetic ring structure is configured to manipulate a magnetic field within the waveguide to excite or perturb a preselected waveguide mode within the waveguide.

21. A method comprising:

forming a magnetic ring structure within a substrate, wherein the magnetic ring structure is positioned within a waveguide for propagating an electromagnetic signal, wherein the waveguide is in contact with the substrate; and propagating the electromagnetic signal through the waveguide, wherein a magnetic flux associated with the magnetic ring structure manipulates a magnetic field within the waveguide to excite or perturb a preselected waveguide mode within the waveguide.

22. The method of claim 21, wherein forming the magnetic ring structure comprises:

forming a loop of magnetic or non-magnetic material that is parallel to a propagation direction of the electromagnetic signal through the waveguide.

23. The method of claim 21, wherein forming the magnetic ring structure comprises:

using a three-dimensional additive process to form a bottom trace, multiple vias, and a top trace defining a loop.

* * * * *